US005323945A

United States Patent [19]

Matoushek

[11] Patent Number: 5,323,945

[45] Date of Patent: Jun. 28, 1994

[54] SEGMENTED DIFFERENTIAL CAPSTAN ROLLER

[75] Inventor: Robert J. Matoushek, Rochester, N.Y.

[73] Assignee: Eastman Kodak Company, Rochester, N.Y.

[21] Appl. No.: 91,530

[22] Filed: Jul. 14, 1993

[51] Int. Cl.[5] ..... B23Q 16/00

[52] U.S. Cl. ..... 226/15; 226/190; 226/188; 492/39; 400/619

[58] Field of Search ..... 226/15, 16, 190, 192, 226/188; 29/115, 123, 125; 400/619

[56] References Cited

U.S. PATENT DOCUMENTS

| | | | |
|---|---|---|---|
| 2,817,940 | 12/1957 | Lorig | 226/92 |
| 3,069,921 | 12/1962 | Davis | 226/92 X |
| 3,507,160 | 4/1970 | McPherson et al. | 226/192 X |
| 3,810,571 | 5/1974 | Fatula | 221/192 |
| 4,335,971 | 6/1982 | deMey | 400/619 |
| 4,395,152 | 7/1983 | Hendrischk | 400/569 |
| 4,415,125 | 11/1983 | Schwengeler | 242/18 DD |
| 5,011,060 | 4/1991 | Cramer | 226/190 X |

FOREIGN PATENT DOCUMENTS

| | | | |
|---|---|---|---|
| 0177896 | 10/1983 | Japan | 226/18 |
| 0064464 | 4/1984 | Japan | 226/15 |
| 0167153 | 6/1989 | Japan | 226/15 |

OTHER PUBLICATIONS

IBM Technical Disclosure Bulletin, vol. 21, No. 3, "Electrostatic Paper Support", Hoekstra et al, Aug. 2, 1978.

*Primary Examiner*—Daniel P. Stodola
*Assistant Examiner*—Paul T. Bowen
*Attorney, Agent, or Firm*—Raymond L. Owens

[57] ABSTRACT

A differential capstan roller for a thermal printer is provided by dividing a capstan roller into first and second end segments, and an intermediate middle segment drivingly engageable with a drive shaft to drive the middle segment, and gearing the first and second end segments together differentially. The first and second end segments are driven with the middle segment through the gearing so that the average velocity of the end segments is equal to the velocity of the middle segment at any instant in time but the velocities of the two end segments are not always equal to each other.

4 Claims, 5 Drawing Sheets

SEGMENTED DIFFERENTIAL CAPSTAN ROLLER

This is a Continuation of application Ser. No. 07/839,152, filed Feb. 21, 1992, now abandoned.

TECHNICAL FIELD

The invention pertains generally to a web transport system, and, more specifically, pertains to a capstan roller for metering long lengths of web material, such as the web material conveyed by a transport system in a thermal printer.

BACKGROUND OF THE INVENTION

In transporting and accurately metering long lengths of web material, a capstan roller with a pinch roller may be used as the metering device. When the web fed through the nip between the capstan roller and pinch roller with a web travel axis at 90° to the capstan axis, and with upstream lateral guidance, the rolling action of the capstan will try to urge the web toward the 90° approach angle. This action requires not only the lateral movement of the web on the roller, but also requires the rotation of the web in its own plane. That rotation causes a non-uniform velocity as measured across the width of the web as it passes over the capstan, which in turn, requires various degrees of slip and/or overdrive on the capstan. This action, which is restricted by the pinch roller, not only detracts from the accurate metering of the capstan, but requires the web to be highly tensioned and in danger of damage.

U.S. Pat. No. 4,395,152 which issued to Wolfgang Hendrisck on Jul. 26, 1983 discloses two friction rollers joined on a drive shaft with a differential being keyed to that shaft to cause one of the rollers that is not held to be driven. The rollers are ultimately held by, preferably, latching devices which are operated on limit positions of the print head. A differential is used to selectively drive or brake two coaxial rollers with one power source while transporting two webs. If the drive selector mechanism is removed, the action of the roller segments will allow web tracking corrections to be made. However, such a use is done in the presence of a strong steering torque which may damage the web. Accordingly, it will be appreciated that it would be highly desirable to have a web tracking correction mechanism that does not produce a dangerous amount of torque.

U.S. Pat. No. 4,335,971, which issued to Charles F. de Mey on Jun. 22, 1982, discloses a metering roller that is segmented to allow the web to rotate in its own plane at the roller for web alignment. The center segment of the roller is driven while the end segments are free to turn about the shaft at the same or different speeds. When a thin web is being transported and the center segment is driven, diagonal folds could develop from points in the web adjacent the driven segment to the edges of the web. It is also possible for nonuniform stretching to occur which would cause distortion in the web operation. Accordingly, it will be appreciated that it will be highly desirable to have a capstan mechanism that allows the web rotation in its plane for tracking alignment and also provide web drive in the entire roller length.

SUMMARY OF THE INVENTION

The present invention is directed to overcoming one or more of the problems set forth above. Briefly summarized, according to one aspect of the present invention, a capstan roller for a thermal printer comprises a longitudinally oriented first end segment with an opening, a longitudinally oriented second end segment with an opening, and a middle segment intermediate the first and second end segments with an opening coextensive with the first and second end segment openings. A central shaft is extendable through the coextensive openings and is drivingly engageable with the middle segment to rotate the middle segment. A first gear is positioned on the central shaft in the first end segment adjacent the middle segment, and a second gear is positioned on the central shaft in the second end segment adjacent the middle segment. A pinion shaft has a first end portion with a first pinion attached thereto, and a second end portion with a second pinion attached thereto, with the second pinion protruding from the middle segment adjacent the second end segment to engage the second gear. A short pinion is engageable with the first pinion internally in the middle segment and protrudes from the middle segment for engagement with the first gear in the first end segment. The first and second gears and pinions form a differential gearing so that the average velocity of the end segments is equal to the velocity of the middle segment at any instant in time although the velocities of the two end segments are not always equal to each other.

According to another aspect of the present invention, a method for producing a differential capstan roller for a thermal printer comprises dividing a capstan roller into first and second end segments, and an intermediate middle segment drivingly engageable with a drive shaft to drive the middle segment, and gearing the first and second end segments together differentially. The method includes driving the first and second end segments with the middle segment so that the average velocity of the end segments is equal to the velocity of the middle segment at any instant in time but the velocities of the two end segments are not always equal to each other.

The differential capstan is a capstan roller that is divided into three segments with the center segment conventionally driven by an external source. The two end segments are geared to each other in differential fashion and are driven by the center segment. By this connection, the average velocity of the end segments is equal to the velocity of the center segment at any instant in time, although the velocities of the two end segments are not always equal to each other. When the segmented capstan roller is used with a matching segmented pinch roller, the unequal velocities allows the required end plane rotation of the web with the accompanying nonuniform cross web velocity to occur with a much lower slip rate and with a much lower web tension than with a single full length capstan.

These and other aspects, objects, features and advantages of the present invention will be more clearly understood and appreciated from a review of the following detailed description of the preferred embodiments and appended claims and by reference to the accompanying drawings.

DETAILED DESCRIPTION OF THE PREFERRED EMBODIMENTS

Figure 1:
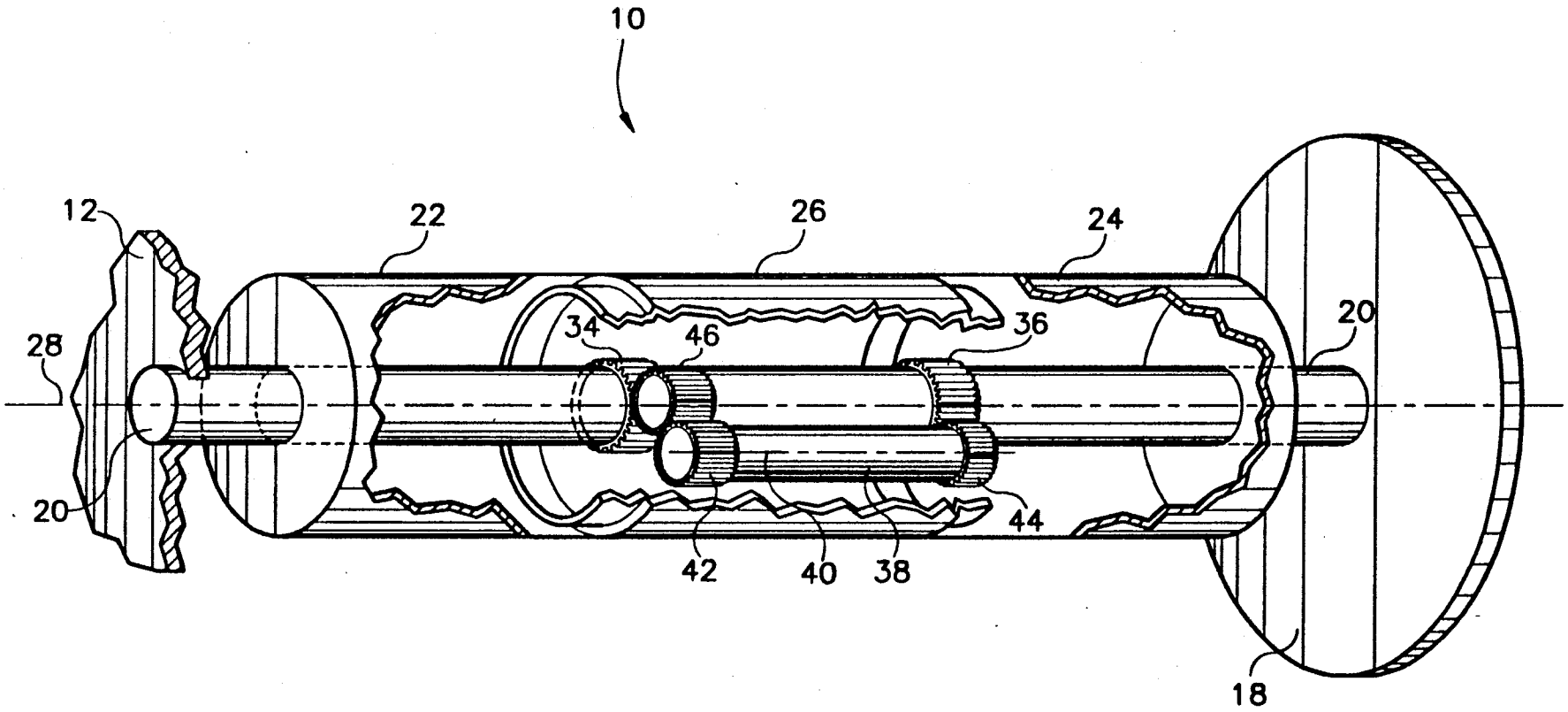
FIG. 1 is a diagrammatic perspective view of a differential capstan roller in accordance with the present invention with sections cut away to reveal the differential gearing.
Figure 2:
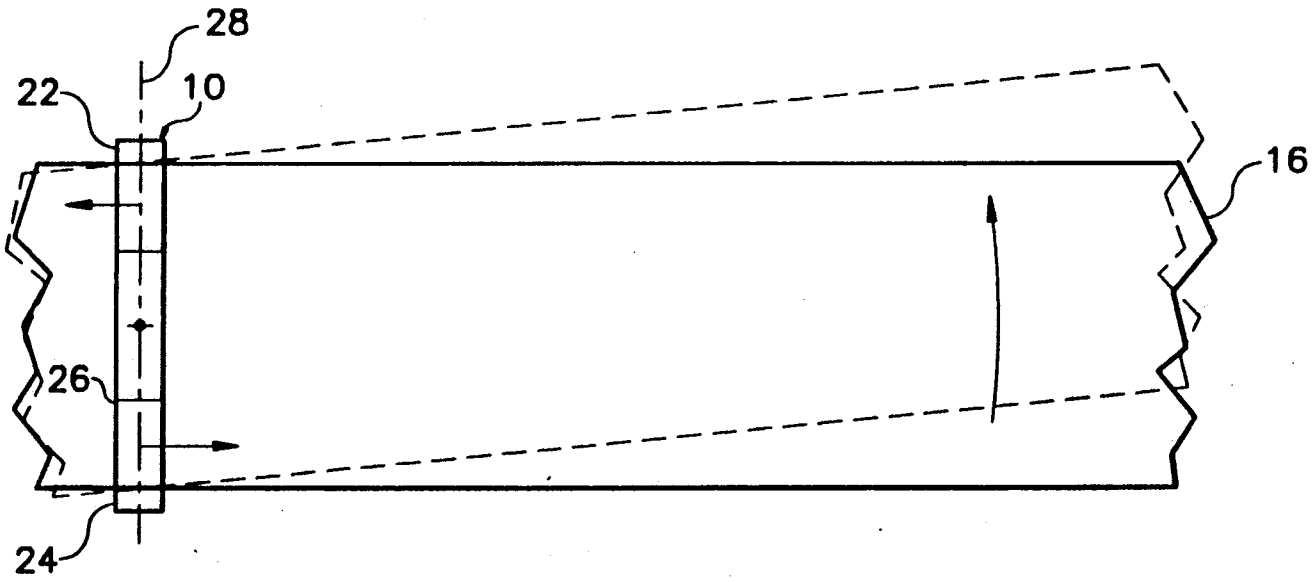
FIG. 2 is a diagram of the capstan roller of FIG. 1 illustrating the relative movement between adjacent segments of the capstan roller when the web material is askew.
Figure 6:
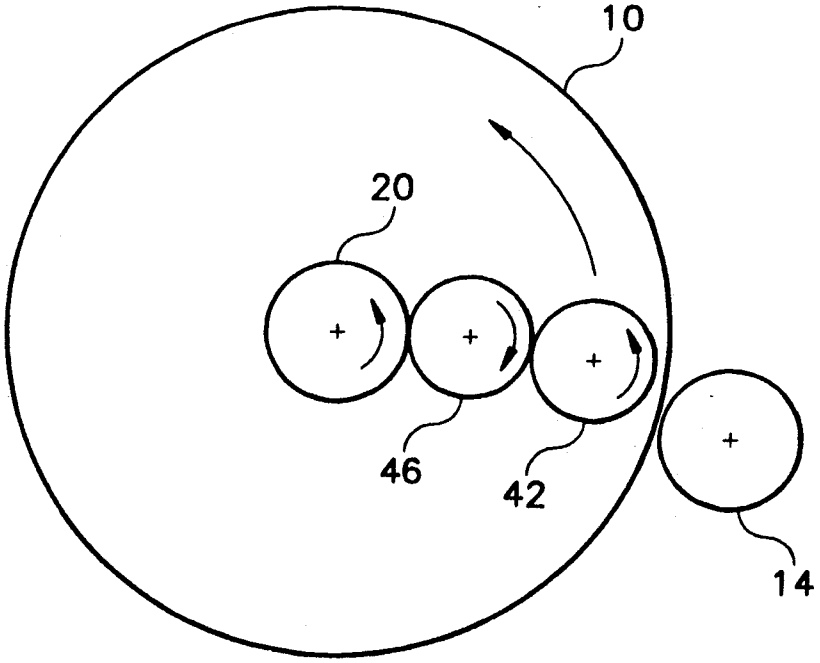
FIG. 6 is a diagrammatic left end view of the capstan roller of FIG. 1 illustrating the alignment and rotation of a portion of the differential gearing.

Referring to FIGS. 1, 2 and 6, a capstan roller 10 for a thermal printer 12 is illustrated The capstan roller 10 works in concert with a pinch roller 14 in a thermal printer 12 to meter a web 16 of material, such as a dye donor web, for example. The printer 12 includes a driving gear or mechanism 18 that is fastened to a shaft 20 for driving the shaft 20 and the capstan roller 10 attached to the shaft 20.

The capstan roller 10 contains a first end segment 22 that has an opening and is longitudinally oriented along the longitudinal axis 28, and a longitudinally oriented second end segment 24 with an opening. A middle segment 26 lies intermediate the first and second end segments 22, 24. The middle segment 26 has an opening coextensive with the openings of the end segments 22, 24. The coextensive openings of the roller segments 22, 24, 26 form a longitudinal opening through which a shaft 20 extends from the driving gear 18.

The middle segment 26 is fastened to the shaft 20 to rotate the middle segment 26 as the shaft 20 rotates about its longitudinal axis 28 in response to being driven by the driving gear 18. The end segments 22, 24 are not connected to the shaft 20 as is the middle segment 26. The connection between the shaft 20 and the middle segment 26 may be by splines, a keyway, or by other manners of connecting items to a rotating shaft.

When assembled on the shaft 20, the first end segment 22 is adjacent one end of the middle segment 26, and the second end segment 24 is adjacent the other end the middle segment 26. Because there will be relative motion between the three segments of the roller 10, it is not desirable that the adjacent segments contact one another along the surface or the ends of the adjacent members; yet, a close fit is desired to cause minimum interference with the web 16. A Lapp joint as shown in FIG. 4 where one of the adjacent end segments 22, 24 extends over a portion of the center segment 26 will work quite well. The object is to present a smooth uniform surface for engagement with the traveling web 16. Each of the roller segments 22, 24, 26 preferably rotates about the central shaft 20 as a pivot point and may be attached to the shaft 20 with bearings. Or the surface of the shaft 20 and the contacting surface of the capstan roller 10 may be bearing surfaces 30, 32 as shown in FIG. 3.

Figure 3:
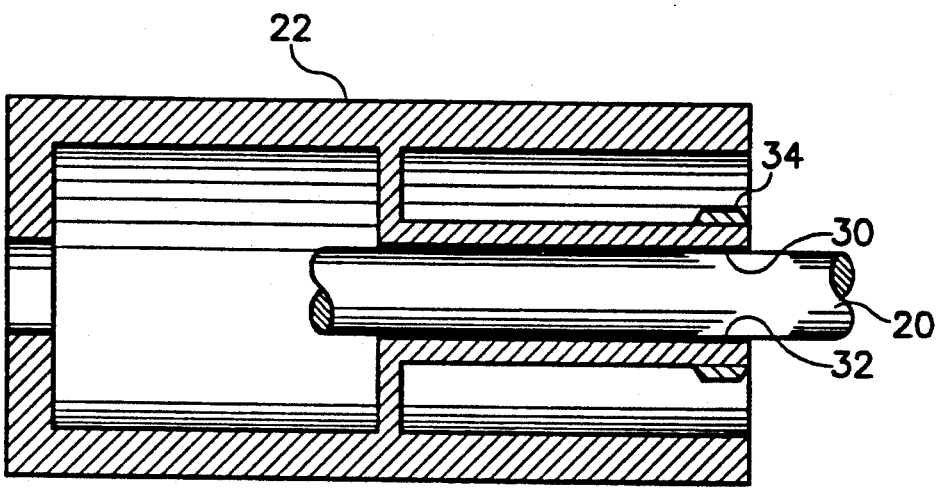
FIG. 3 is simplified sectional view of one of the end segments of the capstan roller of FIG. 1.
Figure 4:
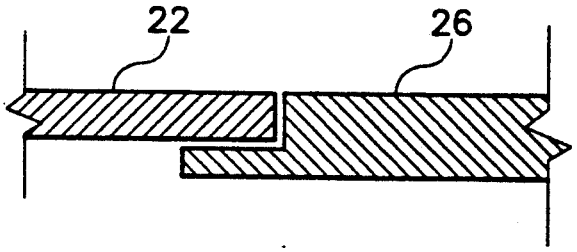
FIG. 4 is a somewhat enlarged sectional view illustrating an overlap joint between center segment of the capstan of FIG. 1 and one of the end segments.
Figure 5:
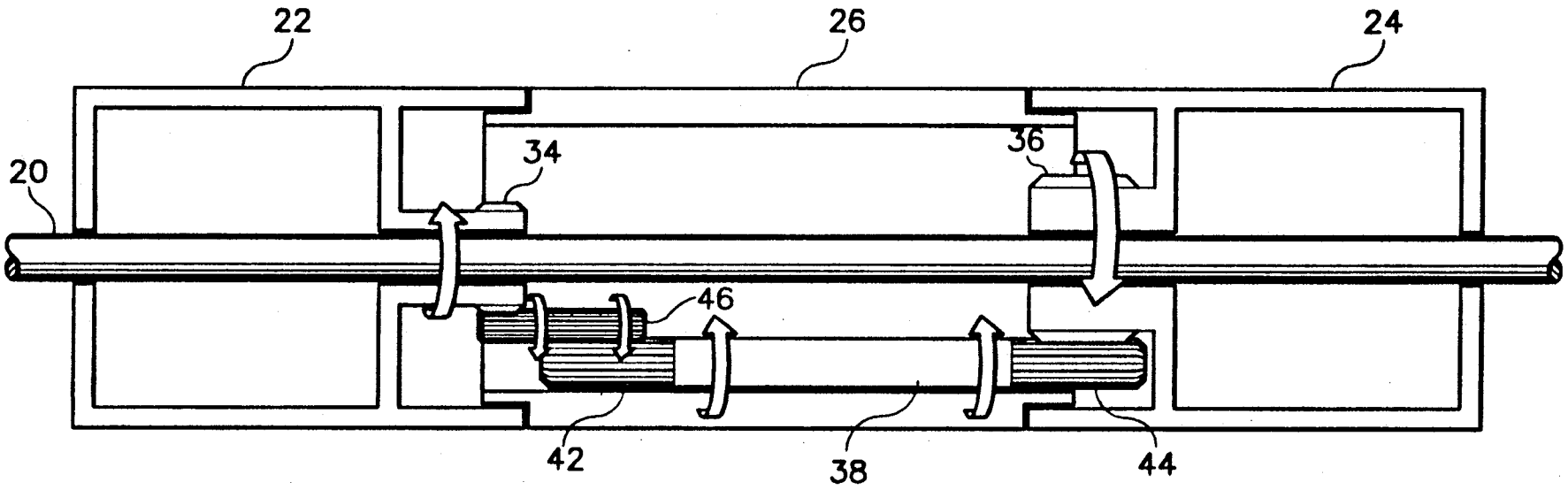
FIG. 5 is a diagrammatic view of the capstan roller of FIG. 1 illustrating the alignment and rotation of the differential gearing.

Referring to FIGS. 3 and 5, the first end segment 22 is illustrated in cross-section to show the gearing in greater detail. It can be seen that the shaft 20 extends through the first segment 22 and that the first end segment contains a gear 34 positioned on the end of the first end segment 22 that is adjacent the middle segment 26. The gear 34 is preferably flush with the end face of the first end segment 22 or slightly recessed therefrom.

The second end segment 24 is constructed in a similar manner to the first end segment 22. It can be seen that the shaft 20 extends through the second end segment 24, and the second end segment 24 contains a gear 36 positioned on the end of the second segment 24 that is adjacent the middle segment 26. The gear 36 is preferably flush with the edge of the second end segment 24 or slightly recessed therefrom. The second segment gear 36 is preferably larger in diametrical dimension than the first segment gear 34, but both can be exactly the same size depending upon the size of the their cooperating gears.

Referring to FIGS. 1, 5 and 6, the center segment 26 of the capstan roller 10 contains a shaft 38 with a longitudinal axis 40. The shaft 38 is affixed to the inside of the cylindrical outer wall of the center segment 26 and travels with the driven center segment 26. As the center segment 26 rotates about the central longitudinal axis 28, the shaft 38 travels in an orbit about the central axis and causes the end segments 22, 24 to rotate with the center segment.

Under certain conditions, the shaft 38 rotates about its own axis 40. These conditions exist, for example, when the web 16 is askew causing unequal forces to act on the roller end segments 22, 24. The rotation of the shaft 38 about its axis 40 facilitates rotational movement of the end segments in different directions at the same time; that is, the first end segment 22 rotates clockwise or forward while the second end segment 24 rotates counterclockwise or backward.

First and second pinions 42, 44 are formed on or affixed to the respective first and second ends of the shaft 38. A short pinion 46 protrudes from the end of the middle segment 26 for engagement with the first gear 34 in the first end segment 22, and engages the first pinion 42 on shaft 38 internally in the middle segment 26. The other end of the shaft 38 has the second pinion 44 protruding from the end of the middle segment 26 adjacent the second end segment 29 to engage the gear 36.

Operation of the present invention is believed to be apparent from the foregoing description and drawings, but a few words will be added for emphasis. The middle roller segment 26, the full length shaft 20 and the input gear 18 are combined, preferably solidly, as one part. The first and second capstan roller segments 22, 24 are bearing mounted on the shaft 20, one at each end of the center segment 26. The first and second roller segments 22, 24 include gears 34, 36 attached thereto respectively. The internal shaft 38 with one of the pinions 42, 44 attached to each end is internally mounted in the center roller segment 26. The mounting is such that one end protrudes axially and meshes with the gear 36 while the other end is flush with the end of the center roller segment 26 and meshes with one end of short pinion 46. Short pinion 46 protrudes into the first roller segment 22. The protruding end of pinion 46 also meshes with gear 34 of the first roller segment 22.

The interconnecting gearing performs much the same as a differential gearing in typical automotive drive wheels except that the center segment 26 is also a drive member. If the roller shaft 20 is locked against rotation while a segmented pinch roller 14 (FIG. 6) forces the web 16 (FIG. 2) against the roller 10, the tensioned web can be rotated with the center 26 of the roller 10 as a pivot. The motion of the roller ends 22, 24 will be equal in magnitude, but opposite to each other in direction as indicated by arrows in the drawings. If the input segment 26 is then driven, all three roller segments will drive regardless of their relative position to each other.

Thus, the shaft 38 will revolve about the shaft 20 along the inside of the middle segment 26 when the web is straight and the forces are even. In this case all three segments will rotate about the shaft 20 in the same direction. However, if the web is not straight, then the forces on the end segments 22, 24 will be unequal and the various gears will enable one end segment to move in a first rotational direction while the end member on the opposite end of the shaft 20 rotates in the opposite rotational direction.

It will now be appreciated that there has been presented a differential capstan roller for a thermal printer. The differential capstan is a capstan roller that is divided into three segments with the center segment conventionally driven by an external source. The two end segments are geared to each other in differential fashion and are driven by the center segment. By this construction, the average velocity of the end segments is equal to the velocity of the center segment at any instant in time, although the velocities of the two end segments are not always equal to each other. For example, when first and second roller segments 22, 24 rotate in the same direction at the same speed, center roller segment 26 will rotate in the same direction at the same speed. When first and second roller segments 22, 24 rotate in opposite directions at different speeds, the center roller segment 26 will turn in the direction of the more rapidly moving end roller segment at one-half the difference of the speed of the first and second roller segments 22, 24. Thus, the velocity (i.e., the magnitude of speed plus direction) of center roller segment 26 is equal to the average velocity of the first and second roller segments 22, 24. When the segmented capstan roller is used with a matching segmented pinch roller, the unequal velocities allows the required end plane rotation of the web with the accompanying nonuniform cross web velocity to occur with a much lower slip rate and with a much lower web tension than with a single full length capstan.

While the invention has been described with particular reference to the preferred embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. For example, the present invention provides a web tracking correction mechanism that does not produce a dangerous amount of torque. The capstan mechanism allows the web to rotate in its plane for tracking alignment and to provide web drive in the entire roller length. It is accordingly intended that the claims shall cover all such modifications and applications as do not depart from the true spirit and scope of the invention.

What is claimed is:

1. An apparatus for receiving, metering, and aligning a web material, said apparatus comprising:

first, second, and third cylindrical rollers axially aligned about a common axis and mounted for rotation about said common axis, said second roller being between said first and third rollers on said common axis such that received web material is trained over said first, second, and third rollers;

means for driving said second roller; and a differential gearing means for interconnecting said first, second, and third rollers such that the average of the instantaneous velocities of the first and third rollers equals the velocity of the second roller, so that changes in alignment of received web material with said first, second, and third rollers will cause differential velocities of said first and third rollers while maintaining the average of the instantaneous velocities of the first and third elements equal to the velocity of the second element, so that a misaligned received web material can be re-aligned with a minimum of (1) slippage of received material on said first, second, and third rollers and (2) tension in received web material.

2. A method for producing an apparatus for receiving, metering, and aligning a web material, said method comprising:

providing a roller having a first, second, and third element;

axially aligning said first, second, and third elements about a common axis;

positioning said second element between said first and third elements on said common axis so that received web material is trained over said first, second, and third elements;

driving said second element; and interconnecting through a differential gearing arrangement said first, second, and third elements such that the average of the instantaneous velocities of the first and third elements equals the velocity of the second element, so that changes in alignment of received web material with said first, second, and third rollers will cause differential velocities of said first and third rollers while maintaining the average of the instantaneous velocities of the first and third elements equal to the velocity of the second element, so that a misaligned received web material can be re-aligned with a minimum of (1) slippage of received material on said first, second, and third rollers and (2) tension in received web material.

3. An apparatus for receiving, metering, and aligning a web material, said apparatus comprising:

a roller having first, second, and third axially aligned elements, said second element being between said first and third elements;

driving means for driving said second element; and a differential gearing arrangement connecting said first, second, and third elements such that the average of the instantaneous velocities of the first and third elements equals the velocity of the second element, so that changes in alignment of received web material with said first, second, and third elements will cause differential velocities of said first and third elements while maintaining the average of the instantaneous velocities of the first and third elements equal to the velocity of the second element, so that a misaligned received web material can be re-aligned.

4. A method for producing an apparatus for receiving, metering, and aligning a web material, said method comprising:

providing a roller having first, second, and third axially aligned elements;

driving said second element which is positioned between said first and third elements; and connecting said first, second, and third elements through a differential gearing arrangement such that the average of the instantaneous velocities of the first and third elements equals the velocity of the second element, so that changes in alignment of received web material with said first, second, and third elements will cause differential velocities of said first and third elements while maintaining the average of the instantaneous velocities of the first and third elements equal to the velocity of the second element, so that a misaligned received web material can be re-aligned.

* * * * *